US005265882A

United States Patent [19]

Malek

[11] Patent Number: 5,265,882

[45] Date of Patent: Nov. 30, 1993

[54] METHOD AND APPARATUS OF PLAYING A NEW CASINO GAME

[76] Inventor: Mehrdad M. Malek, 1306 Daviswood Dr., McLean, Va. 22102

[21] Appl. No.: 16,308

[22] Filed: Feb. 11, 1993

[51] Int. Cl.[5] ..... A63F 1/00

[52] U.S. Cl. ..... 273/292; 273/274; 273/309

[58] Field of Search ..... 273/292, 274, 309

[56] References Cited

U.S. PATENT DOCUMENTS 5,013,049 5/1991 Tomaszewski ..... 273/292
5,042,818 8/1991 Weingardt ..... 273/292
5,154,429 10/1992 Le Vasseur ..... 273/292

*Primary Examiner*—Benjamin H. Layno
*Attorney, Agent, or Firm*—Parkhurst, Wendel & Rossi

[57] ABSTRACT

A method and apparatus for playing a mixture of Twenty-One, modified Draw Poker and Baccarat wherein a player simultaneously plays at least two of the three games against the dealer and other players.

19 Claims, 3 Drawing Sheets

METHOD AND APPARATUS OF PLAYING A NEW CASINO GAME

This invention relates to a card game, in particular to a card game suitable for use in casinos, and to a specifically designed table for playing the game. More specifically, this invention relates to a method of and apparatus for playing a mixture of Twenty-One, a modified Draw Poker, and Baccarat wherein a player simultaneously plays against a dealer and other players.

BACKGROUND OF THE INVENTION

There are many card games which can be used for gambling purposes, but often these games are played only against the casino/bank. Also, each card game is usually played individually and it is rare to play more than one type of gambling game against the dealer at any given time. U.S. Pat. No. 5,154,429 discloses a method of playing multiple action blackjack, but the play is limited to each player versus the dealer, who represents the casino or bank, and the play is limited solely to blackjack. Other casino games are disclosed in U.S. Pat. Nos. 4,651,997; 4,659,087; 4,836,553; 5,013,049; 5,098,107; 5,141,234; and 5,174,579.

There is also another casino game known as Pai-Gow Poker (also known as Asian Poker). In this game each player plays against the bank (Casino) and each receives seven cards after placing their bets against the bank. Then each player picks up his cards and sets them in two hands consisting of a two card set (one set having five cards, the other set having two cards) according to the rules of Draw Poker. Both hands must be winners against the Casino in order to win the game against the Casino. If one hand wins and the other hand loses it will be a push and the bet will stay for the next round of play.

However, heretofore a card game has not been proposed wherein the player challenges not only the dealer but other players, and also the player can play Twenty-One, Draw Poker, and Baccarat simultaneously, thus significantly increasing the odds of winning against the bank.

SUMMARY OF THE INVENTION

It is an object of the present invention to provide a gambling game which is a mixture of Twenty-One, a modified Draw Poker, and Baccarat, wherein the player can simultaneously play all three games not only against the dealer, but against other players.

The present invention relates to a method of playing a mixture of Twenty-One, modified Draw Poker and Baccarat wherein a player simultaneously plays against a dealer and other players, comprising:

providing a playing station for each player, said playing station comprising:

(i) a card playing area having a first horizontal row of two boxes, a second horizontal row of five boxes, and a third row of two boxes;

(ii) a bank betting area positioned to one side of the card playing area and having three positions corresponding to said first, second, and third rows of boxes in said card playing area; and (iii) a player betting area positioned to the other side of the card playing area and having three positions corresponding to said first, second and third rows of boxes in said card playing area;

each player making a first bet in at least two of said three positions in said bank betting area of their playing station;

the dealer dealing a first card face-up to each player and one card face-down to the dealer;

at least one player making a second bet in at least one of said three positions in said player betting area of his playing station;

the dealer dealing additional cards face-down to each player, the total number of cards dealt to each player being determined based on the position of each first bet in the bank betting area of each playing station and the number of boxes in each row corresponding to said position;

the dealer dealing to himself additional cards equal to the highest number of cards dealt to any one player;

each player organizing his cards in up to three hands corresponding to two cards for Twenty-one, five cards for Draw Poker and two cards for Baccarat, and then assembling those organized cards in each of said first, second, and third rows of boxes corresponding to each position in the bank betting area of each player station in which the player has placed a first bet;

the dealer assembling his dealt cards in a playing station in a manner corresponding to said one player having the highest number of dealt cards;

the dealer comparing the cards assembled in each row of boxes in his playing area to cards assembled in corresponding rows of boxes in each player playing station and collecting or paying said first bets in each bank betting area of each playing station; and the dealer comparing cards assembled in each row of boxes in each player playing station and settling said second bets between players in each player betting area of each playing station.

The present invention also relates to an apparatus for playing a mixture of Twenty-One, modified Draw Poker and Baccarat wherein a player simultaneously plays against a dealer and other players, said apparatus comprising:

a table having an upper playing surface;

a dealer playing station at a first position on said playing surface, said dealer playing station comprising three horizontal rows of boxes, the first row including two boxes, the second row including five boxes and the third row including two boxes; and a plurality of player playing stations at spaced positions on the playing surface and opposed to said dealer playing station, each of said player playing stations comprising three horizontal rows of boxes arranged in the same manner as in the dealer playing station, a bank betting area positioned to one side of the rows of boxes and having three positions corresponding to said first, second and third rows of boxes, and a player betting area positioned to the other side of the horizontal rows of boxes and having three positions corresponding to said first, second, and third rows of boxes.

These and other objects of the present invention will be better understood after reviewing the following detailed description taken in conjunction with the attached drawings.

DETAILED DESCRIPTION OF THE PREFERRED EMBODIMENTS

Figure 1:
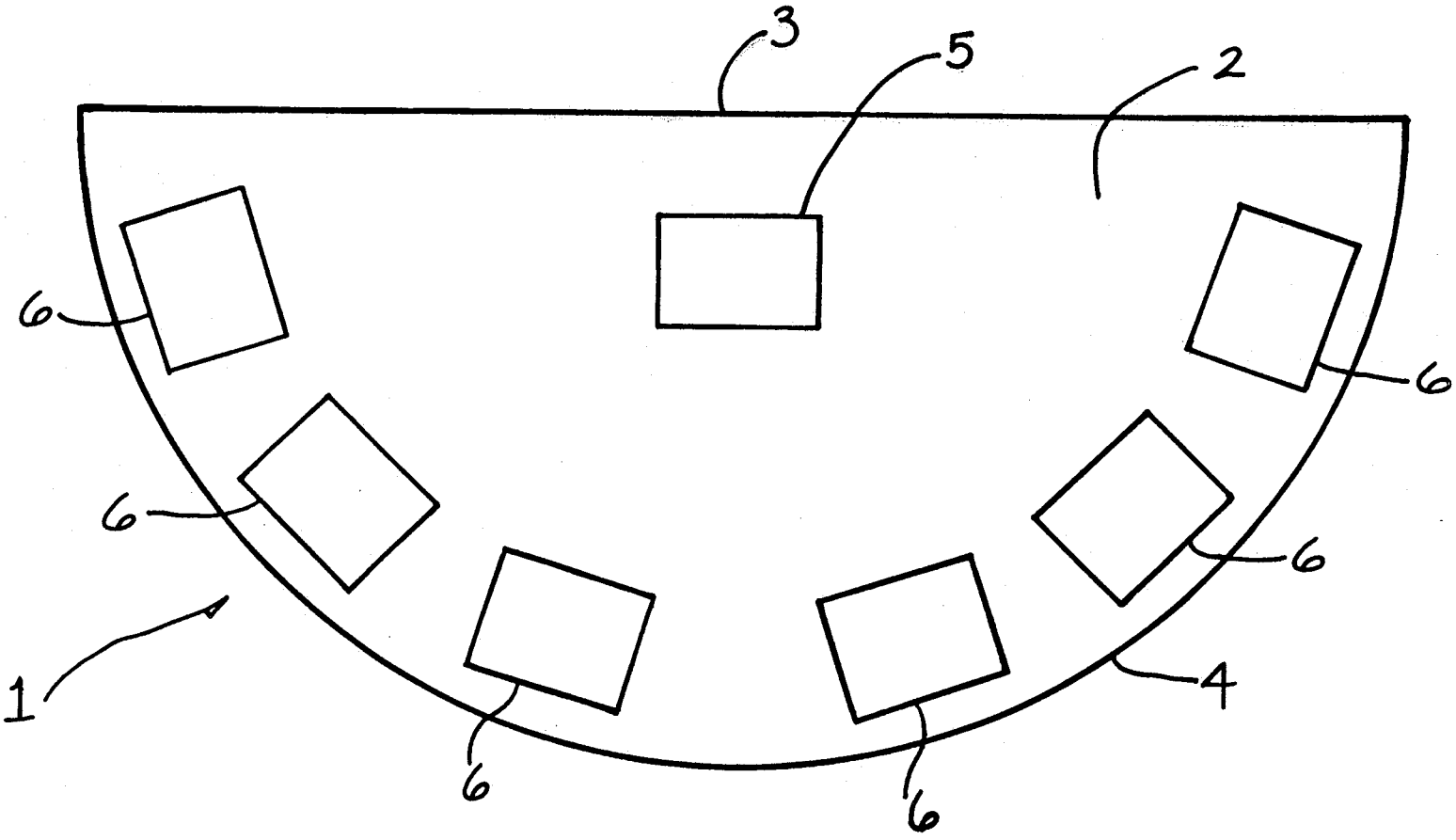
FIG. 1 shows a preferred layout of the apparatus of the present invention which is used in connection with the method of the present invention.

FIG. 1 shows a preferred set-up for the apparatus of the present invention. More specifically FIG. 1 shows a preferred embodiment of the apparatus of the present invention, which includes a table 1 having an upper playing surface 2 formed substantially in the shape of a semicircle. The surface 2 has a substantially linear side 3 along the diameter of the semicircle and a curved side 4 along the circumference of the semicircle. A dealer playing station 5 is arranged substantially midway along the diameter of the semicircular playing surface. Six player playing stations 6 are arranged along the circumference of the semicircular playing surface and are spaced an equal distance apart.

Figure 1A:
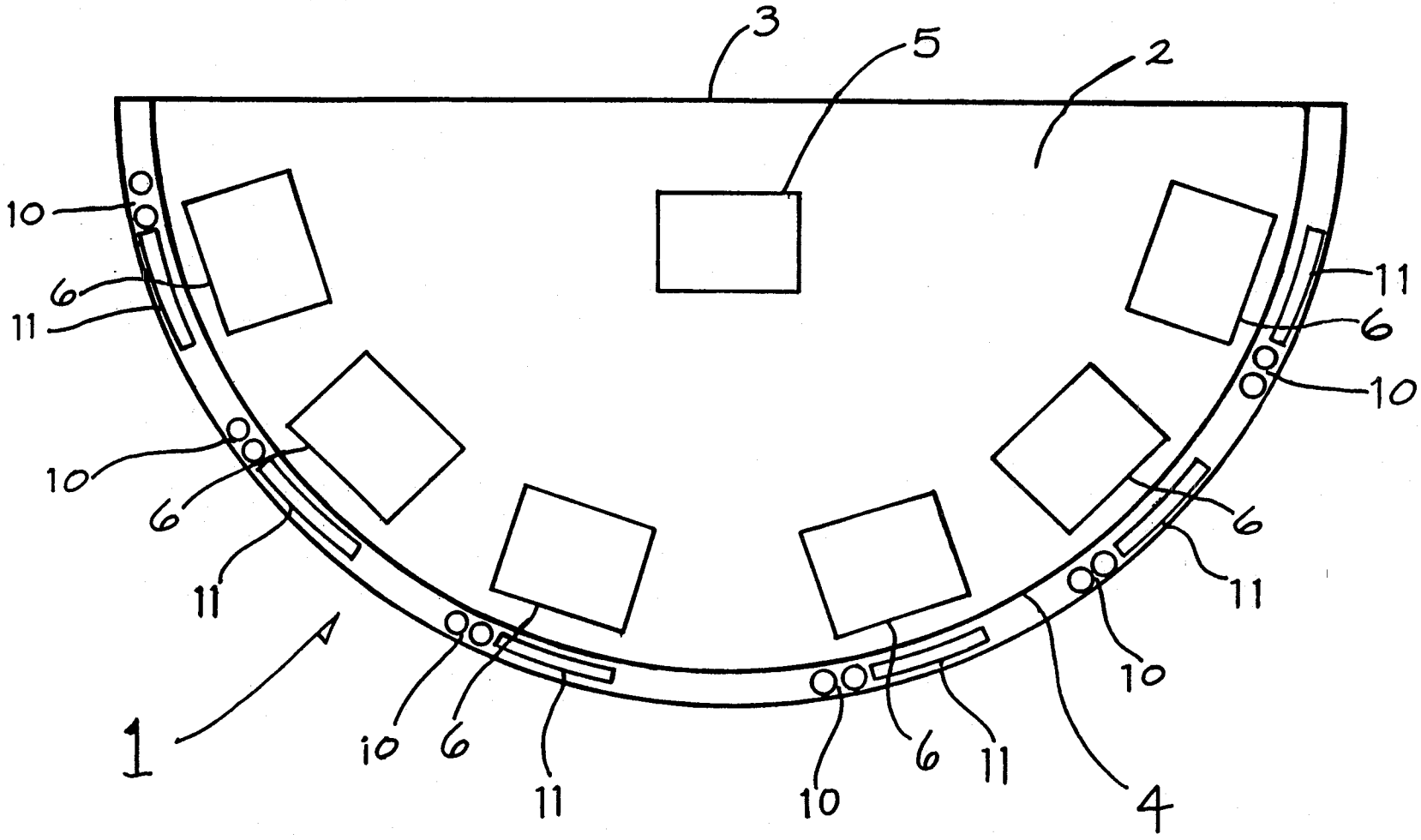
FIG. 1A shows a modified version of the apparatus of FIG. 1.

FIG. 1A shows a modified version of the apparatus of FIG. 1, which includes openings 10 through the table 1 and individual chip trays 11 for each player. The openings can be used to hold drinks, ash trays, and the like.

Figure 2:
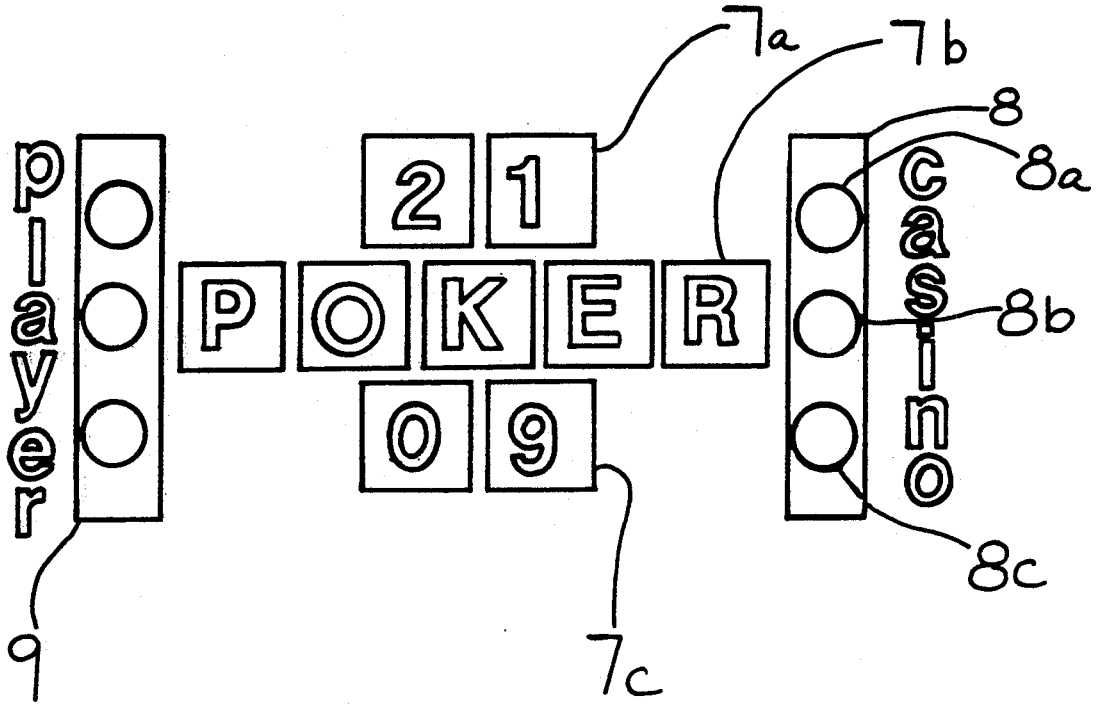
FIG. 2 shows an enlarged view of an individual player playing station in accordance with the apparatus and method of the present invention.

FIG. 2 shows an enlarged view of an individual player playing station 6 of FIG. 1. Each player playing station 6 includes three horizontal rows of boxes 7*a*, 7*b*, 7*c*, the first including two boxes, the second including five boxes, and the third including two boxes. Although these rows can be arranged in any order, preferably the first row of boxes is used to play Twenty-One, the second row of boxes is used to play modified Draw Poker and the third row of boxes is used to play Baccarat. This set-up is so labeled in FIG. 2. Arranged to one side of the three rows of boxes is a casino or bank betting area 8 which has three positions 8*a*, 8*b*, 8*c* corresponding to each row of boxes. It is in the bank betting area where the player places a bet against the casino in at least two of the three positions corresponding to the two games in which the player wishes to play against the dealer. On the other side of the three rows of boxes is the player betting area 9 wherein the player can bet against other players as if he was betting against the bank. The dealer playing station 5 includes the same three horizontal rows of boxes provided in each player playing station, but the bank and player betting areas can be omitted from the dealer playing station.

The playing table 1 can include any number of player playing stations 6, but preferably, this number is limited to six to facilitate monitoring by the dealer.

The present invention is carried out in the following manner. The dealer begins with six standard decks of fifty-two cards comprising a total of 312 cards which are placed in a shoe, after shuffling, for distribution. This is very similar to conventional blackjack techniques, although the casino can add or subtract decks of cards as desired. For the purposes of explaining the game, we will assume that six player positions are used and are all occupied. The bank is always held by the casino, as is a standard practice in any commercial establishment. Conventional shuffling and cutting of the cards is carried out by the dealer before commencement of the game.

Prior to any cards being dealt, each player places a first bet against the dealer in the bank betting area 8 of his playing station. In order to participate, each player must bet at least two of the three games in the bank betting area 8 of his station. The bet placed in each position 8*a*, 8*b* and/or 8*c* should be of equal value according to the minimum and maximum bets allowed by the Casino.

After all bets are made against the bank, the dealer then proceeds to deal one card face-up to each player, and one card face-down to himself. After the players assess their card against the card of each other player, the highest ranking card on the table has the option to place an additional bet against all other players in the player betting area 9 of his playing station. The player is limited to betting against other players in only those games in which he has also bet against the dealer. For example, if the highest card-holding player bet two games against the dealer, and wishes to bet against other players, he must bet those same two games in the player betting area 9 of his station. If the player holding the highest ranking card does not wish to bet against other players, this optional betting privilege then passes to the second highest-ranking card holder on the table, and if he passes, to the third highest-ranking card holder on the table. If all three of these players pass, then no optional, inter-player bets can be placed. If one of these three players makes a second bet, then it is up to other players to decide whether to match that bet. If no other players match that bet, then the betting player removes his bet from his player betting area 9. If more than one player holds the highest-ranking card on the table (e.g., three players are dealt an ace), then the optional betting against other players commences clockwise around the table among the players.

Assume, however, that the player holding the highest-ranking card dealt by the dealer decides to place a second bet in the player betting area 9 of his station. That player must then place bets in the player betting area 9 of his station corresponding to the exact games in which he has bet against the bank. For example, if the player previously decided to bet against the bank in Twenty-One and Draw Poker, then the player is limited to any second bets against other players in both of Twenty-One and Poker. After the player holding the highest-ranking card on the table places his bet, the remaining player can place second bets in their respective player betting areas 9 to match the second bets of the highest ranking card holder.

After all second bets are placed by the players, the dealer then deals single cards to each of the players and himself in a traditional clockwise fashion. The number of cards which each player receives from the dealer depends upon which games each player has bet against the bank. For example, if a player decides to bet all three games against the bank, then the dealer will ultimately provide him with nine cards. Although the first card dealt to each player is face-up, each card thereafter is dealt face-down. All cards dealt to the dealer are face-down.

Now assume that six players have decided to bet each three games against the dealer by placing a bet of equal value in their respective bank-betting areas 8 at each position 8*a*, 8*b*, 8*c* corresponding to each three rows of boxes. The dealer would deal to each player a total of nine cards. The dealer would also take nine cards, all face-down for himself. Again, it is customary that the dealer distributes cards to the players one-by-one in a clockwise manner around the table. Often times the dealer is dealt his cards in turn with the players.

Now, assuming that each player has bet all three games against the bank and has or has not made second bets against other players, the dealer will have dealt nine cards to each player. The players gather those cards in their hands and in a timely manner, set three different hands in each of the respective three horizontal rows of boxes *7a, 7b, 7c* in their playing station 6. More specifically, each player will take his two best cards for Twenty-One and place those cards face-down in the first row *7a* of his playing station. Each player will then take his five best cards for Draw Poker and his remaining two best cards for Baccarat and place those cards face-down in the second *7b* and third *7c* rows, respectively, of his playing station 6. The dealer also arranges his cards in this manner face-down. The game requires that the player evaluate his nine cards and come up with the best three hands for each of Twenty-One, Draw Poker and Baccarat, depending upon bets placed against the bank as well as bets placed against other players.

After each player has assembled all cards face-down in his playing station 6, the dealer then, perhaps with the help of an assistant, turns over each card in its respective box in each player station 6. The dealer then turns over each one of his cards as previously positioned by him in the three rows *7a, 7b, 7c* in his playing station 5.

Now the dealer compares each one of his hands against each corresponding hand of each player. In the first row *7a* of boxes where Twenty-One is played, the dealer compares his two cards to the two cards in each corresponding row of each player station. The person whose two cards add closest to or equal to 21 wins. Any ties constitute a so-called "push". Then the dealer compares the five cards in his second row *7b*, or Draw Poker row, against the corresponding row in each player station, and the cards in his third row *7c*, or Baccarat row, against the cards in each corresponding row in each player station.

The rules of Twenty-One apply in the Twenty-One row (i.e., closest to 21 wins) except there will be no blackjack for the players or the dealer. The rules of Draw Poker apply in the Draw Poker row. Royal flush wins over straight flushes of the same values. Traditional Baccarat rules apply in the Baccarat row, in that the player or dealer having two cards totaling closest to nine wins and nine is the winner over all other values. Face cards and tens are counted as ten in Twenty-One, have their own values in Draw Poker, and count as zero in Baccarat. Aces are 11 in Twenty-One and are counted as 1 in Baccarat. All other cards have their own face values.

After the dealer evaluates his hands against the corresponding hands of each player, he settles any bets in the bank betting area 8 of each player station. That is, the dealer first settles any bets between each player and the bank. Then the dealer compares the hands of each player against other players when second bets have been made by one or more players in the player betting area 9 of each station. In fact, the players are now playing against each other and the dealer acts as a broker for settling all bets among players. In return for this, it is conceivable that the casino would require a 5% commission on any second bets between players.

Preferably, the dealer first turns over only the cards in the Twenty-One row of each player station and the dealer playing station, settles bets between the bank and all players, and then settles bets between the players. The dealer then moves to the Draw Poker row and repeats this process, and then to the Baccarat row and again repeats this process.

After all bets are settled between the bank and among players, the cards are collected and the game is continued as described above. Conventional "push" rules apply as in Twenty-One in that any ties between the dealer and individual players or among players results in no money changing hands and the option of that player to make additional bets on the next hand or remove that bet before playing the next hand. And, as in conventional blackjack, if during distribution of the cards, the marker in the shoe shows that there may not be enough cards for all the components of the game to be played, the cards are simply reshuffled before proceeding with play.

Although in the above description, it is assumed that each player bet all three games against the bank, it is permitted for one or more players to bet only two games against the bank. For example, each player has the option of playing any two of the three games of Twenty-One, Draw Poker and Baccarat and his decision as to which two games to play is identified by placement of his betting chip in the bank betting area 8 of his playing station. If the player places a betting chip in the first position 8*a* of the bank betting area, he has elected to play Twenty-One against the dealer. The same indication applies if the player places his betting chip in the second position 8*b* in his bank betting area corresponding to the second, or Draw Poker, row *7b* and third position corresponding to the third, or Baccarat, row *7c*.

Accordingly, the dealer determines how many cards to deal each player depending upon which games each player has elected to play by betting against the bank. The dealer determines how many cards to deal himself based upon the highest number of cards dealt to any one player. For example, if six players are playing against the dealer, and five of the six elect Twenty-One and Baccarat, whereas the sixth player elects to play all three games against the dealer, then the dealer will deal himself nine cards in order to complete the games against the sixth player. The dealer would also play his Twenty-One and Baccarat cards against each of the remaining five players.

The present invention provides a novel and unique gaming method and apparatus which allows more experienced players to increase their odds against the bank and at the same time provides the bank/casino more opportunities to gain revenues from each player more rapidly. As explained above, the present invention combines Twenty-One, Poker and Baccarat to allow each player to play each game simultaneously against the bank as well as second wagers against other players. The inventor believes that the present invention provides an exciting new parameter to casino play which has never yet been provided.

Although the present invention has been described above in detail, it is not limited to the specific embodiments described herein. Various modifications and additions may be made and will be apparent to those skilled in the art. For example, the present invention could be easily adapted for electronic play or as a home board game in the same manner that blackjack and other popular games have been adapted in the past. Accordingly, the invention should not be limited to the foregoing description but rather should be defined only by the following claims.

What is claimed is:

1. A method of playing a mixture of Twenty-One, modified Draw Poker and Baccarat wherein a player simultaneously plays against a dealer and other players, comprising:

providing a playing station for each player, said playing station comprising:

(i) a card playing area having a first horizontal row of two boxes, a second horizontal row of five boxes, and a third horizontal row of two boxes;

(ii) a bank betting area positioned to one side of the card playing area and having three positions corresponding to said first, second, and third rows of boxes in said card playing area; and (iii) a player betting area positioned to the other side of the card playing area and having three positions corresponding to said first, second and third rows of boxes in said card playing area;

each player making a first bet in at least two of said three positions in said bank betting area of their playing station;

the dealer dealing a first card face-up to each player and one card face-down to the dealer;

at least one player making a second bet in at least one of said three positions in said player betting area of his playing station;

the dealer dealing additional cards face-down to each player, the total number of cards dealt to each player being determined based on the position of each first bet in the bank betting area of each playing station and the number of boxes in each row corresponding to said position;

the dealer dealing to himself additional cards equal to the highest number of cards dealt to any one player;

each player assembling cards dealt from the dealer in each of said first, second, and third rows of boxes corresponding to each position in the bank betting area of each player station in which the player has placed a first bet;

the dealer assembling his dealt cards in a dealer playing station in a manner corresponding to said one player having the highest number of dealt cards;

the dealer comparing the cards assembled in each row of boxes in his playing area to cards assembled in corresponding rows of boxes in each player playing station and collecting or paying said first bets in each bank betting area of each playing station; and the dealer comparing cards assembled in each row of boxes in each player playing station and settling said second bets between players in each player betting area of each playing station.

2. The method of claim 1, wherein all additional cards dealt to each player are face-down, and all cards dealt to the dealer are face-down.

3. The method of claim 1, wherein each first bet placed in the bank betting area of each playing station is equal to the same value.

4. The method of claim 1, wherein second bets placed by any player in his player betting area correspond in position to each first bet in his bank betting area.

5. The method of claim 1, wherein cards are dealt to the players and dealer in a single fashion and in a clockwise manner.

6. The method of claim 1, wherein six fifty-two-card decks are used by the dealer.

7. The method of claim 6, wherein up to six players are participating at one time.

8. The method of claim 1, wherein said first row of two boxes is used to play Twenty-One, the second row of five boxes is used to play Draw Poker, and the third row of two boxes is used to play Baccarat.

9. The method of claim 8, wherein each player makes a first bet in each of said three positions in the bank betting area of their playing station, and the dealer deals a total of nine cards to each player.

10. The method of claim 1, wherein the player receiving the highest ranking first card from the dealer is the first player to make a second bet in the player betting area of his playing station.

11. A method of simultaneously playing at least two of the three games of Twenty-One, modified Draw Poker, and Baccarat wherein a player plays against a dealer and other players, comprising:

each player making at least two first bets against the dealer to be eligible to play one hand in each of at least two of the three games;

the dealer dealing a first card face-up to each player and one card face-down to the dealer;

at least one player making second bets against other players based on the first card received from the dealer;

the dealer dealing up to eight additional cards face-down to each of the players and to the dealer depending upon which games each player has placed first bets against the dealer;

each player and the dealer assembling the cards received from the dealer in as many groups as first bets placed by each player, wherein two cards are assembled for Twenty-One, five cards are assembled for Draw Poker and two cards are assembled for Baccarat;

the dealer comparing each of his assembled groups of cards to corresponding groups of cards of each player, paying each player having a winning hand compared to the corresponding hand of the dealer, and collecting bets from each player having a losing hand compared to the corresponding hand of the dealer; and the dealer comparing the assembled groups of cards of each player to settle any second bets made among the players.

12. An apparatus for playing a mixture of Twenty-One, modified Draw Poker and Baccarat wherein a player simultaneously plays against a dealer and other players, said apparatus comprising:

a table having an upper playing surface;

a dealer playing station at a first position on said playing surface, said dealer playing station comprising three horizontal rows of boxes, the first row including two boxes, the second row including five boxes and the third row including two boxes; and a plurality of player playing stations at spaced positions on the playing surface and opposed to said dealer playing station, each of said player playing stations comprising three horizontal rows of boxes arranged in the same manner as in the dealer playing station, a bank betting area positioned to one side of the rows of boxes and having three positions corresponding to said first, second and third rows of boxes, and a player betting area positioned to the other side of the horizontal rows of boxes and having three positions corresponding to said first, second, and third rows of boxes.

13. The apparatus of claim 12, wherein the playing surface is formed substantially in the shape of a semicircle having a substantially linear side along the diameter of the semicircle and a curved side along the circumference of the semicircle.

14. The apparatus of claim 12, wherein the dealer playing station is arranged substantially midway along the diameter of the semicircular playing surface and the player playing stations are arranged along the circumference of the semicircular playing surface and spaced an equal distance apart.

15. A method of simultaneously playing Twenty-One, modified Draw Poker and Baccarat wherein players play against the dealer and other players, comprising the steps of:

a) each player making a first wager to participate against the dealer simultaneously in a combination of at least two of the following games: Twenty-One, Draw Poker and Baccarat;

b) the dealer dealing one card face up to each player and one card face down to the dealer;

c) at least one player making a second wager to participate in at least one game of Twenty-One, Draw Poker and Baccarat against other players who match said second wager;

d) the dealer dealing up to eight additional cards face down to each player and to the dealer;

e) each player and the dealer organizing his cards in up to three sets: two cards for Twenty-One, five cards for Draw Poker and two cards for Baccarat, and arranging the sets of cards face down;

f) the dealer turning over the sets of cards of each player and the dealer; and g) the dealer settling first wagers between the bank and each player, and then settling second wagers between players.

16. The method of claim 15, wherein at least one player participates against the dealer in all three games, and that player and the dealer are dealt a total of nine cards.

17. The method of claim 15, wherein said at least one player of step (c) received the highest ranking card from the dealer in step (b).

18. The method of claim 17, wherein said at least one player places said second wager only in at least one game in which that player has placed a first wager against the dealer.

19. The method of claim 15, wherein steps (f) and (g) are performed first in the Twenty-One game, second in the Draw Poker game and then third in the Baccarat game.

* * * * *